US005936645A

United States Patent [19]

Niikura et al.

[11] Patent Number: 5,936,645

[45] Date of Patent: Aug. 10, 1999

[54] SERIAL PRINTING APPARATUS CONTROLLED BY OPEN LOOP CONTROL SYSTEM

[75] Inventors: Takeji Niikura; Tomoaki Masaki, both of Kawasaki; Akiyoshi Shimoda, Yokohoma, all of Japan

[73] Assignee: Canon Kabushiki Kaisha, Tokyo, Japan

[21] Appl. No.: 08/374,099

[22] Filed: Jan. 18, 1995

[30] Foreign Application Priority Data

Jan. 19, 1994 [JP] Japan ..... 6-004032

[51] Int. Cl.[6] ..... B41J 29/38; B41J 23/00

[52] U.S. Cl. ..... 347/14; 347/37

[58] Field of Search ..... 347/19, 37, 14; 40/322, 903

[56] References Cited

U.S. PATENT DOCUMENTS

| | | | |
|---|---|---|---|
| 4,167,014 | 9/1979 | Darling et al. | 347/37 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,033,889 | 7/1991 | Carney . | |
| 5,075,609 | 12/1991 | Ito et al. | 318/696 |
| 5,416,395 | 5/1995 | Hiramatsu et al. | 318/600 |

FOREIGN PATENT DOCUMENTS

| | | |
|---|---|---|
| 0634279 | 1/1995 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 60-147373 | 8/1985 | Japan . |
| 1087360 | 3/1989 | Japan . |
| 1154762 | 6/1989 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

On the basis of an encoder output pulse generated by useing a linear encoder film provided along a moving path of a carriage, ink ejection timing is determined. Then, the ink ejection timing is set at a timing derived by dividing a period of the output pulse by three, and the pulse period to be divided is the immediately preceding pulse period. By this, even with open loop control of driving of a carriage motor, high precision ejecting position control can be performed.

17 Claims, 7 Drawing Sheets

1/120"
1/240"

ENCODER FILM 24

ENCODER OUTPUT
PHASE A
PHASE B

EJECTION TIMING
(RESOLUTION 1/360")

SERIAL PRINTING APPARATUS CONTROLLED BY OPEN LOOP CONTROL SYSTEM

BACKGROUND OF THE INVENTION

1. Field of the Invention

The present invention relates to a serial printing apparatus. More specifically, the invention relates to an ink-jet apparatus controlling an ejection timing control.

2. Description of Prior Art

The recording apparatus can be generally classified into two kinds, i.e. serial type and full line type depending upon the configuration of a recording head. Among these, the serial type recording apparatus is to perform recording while the head is moving and is the type generally used. The most well known device of this kind is an ink-jet printing apparatus for printing characters and images and so forth by ejecting an ink toward a recording medium, such as a paper. Such ink-jet printing apparatus is typically used as an information output means of a printer, a copy machine, facsimile and so forth.

As a system that performs recording by ejecting the ink while the ink-jet head is moved, speed control for a carriage which mounts the ink-jet head and carries it, and an ejection timing control associated with motion of the carriage are important factors for determining a quality of a recorded image as the result of printing (hereinafter also referred to recording). More specifically, when the carriage is moved for recording (this moving is hereinafter also referred to as "scan"), the speed condition of the carriage transits in acceleration state, constant speed state and deceleration state. Normally, ink ejection is performed during the constant speed state. However, even in the constant speed zone, there is a slight fluctuation of the carriage motion speed. Therefore, it is desirable to restrict speed variation of the carriage during motion across the constant speed zone.

Such carriage speed control is frequently a closed loop control for driving the carriage motor, in which an output of an encoder detecting motion information of the carriage is used as a feedback signal. In this case, the encoder output is generally obtained from an optical or magnetic rotary encoder or linear encoder provided in a part of the ink-jet recording apparatus.

On the other hand, the ejection timing control is performed so that dots formed on the recording medium are arranged at a desired pitch by ejection of the ink in a scanning direction and determines the quality of recorded image in association with the carriage speed control. In the case that the carriage speed is controlled in closed loop, a detection signal of a linear encoder detecting the carriage motion information is used for controlling the ejection timing.

However, in the prior art set forth above, when the closed loop control of the carriage motor is performed, load on a CPU is increased for this process to result in lowering of a through-put of the overall apparatus due to lowering of the process speed in the CPU. When attempt is made to improve performance of the CPU for avoiding the problem of lowering of through-put, significant cost-up problem is concerned.

On the other hand, associating with increasing of density of ejection orifices of the recent ink-jet head, recording of image at higher resolution is becoming possible. In such case, the dot pitch in the scanning direction (an interval between ejection timings) has to be made smaller. In order to directly and easily realize this, increasing of resolution of the linear encoder can be considered. However, in order to increase resolution of the linear encoder, higher density of integrating of the elements and of scale becomes necessary to inherently cause a problem of cost-up.

SUMMARY OF THE INVENTION

It is an object of the present invention to provide a serial printing apparatus which can perform carriage motor drive control and driving timing control without causing degradation of through-put or a cost-up problem.

Another object of the present invention is to provide a serial printing apparatus which controls driving of a carriage in open loop manner and performs a driving control of a head at a timing determined by dividing an immediately preceding period of a periodic signal representing motion information of the carriage.

In a first aspect of the present invention, there is provided an apparatus using a head for performing a printing to a medium, comprising:

a carriage for mounting the head and for moving along the medium;

driving means for moving the carriage;

detecting means for detecting motion information of the carriage and supplying a periodic signal relating to the detection; and control means for controlling a driving of the driving means in open loop and for performing driving timing control for making the head to be driven within each period of the periodic signal supplied from the detection means, the driving timing of the head being set at driving timing having time interval derived by dividing an immediately preceding period of the periodic signal into n (:natural number).

In a second aspect of the present invention, there is provided a drive control method for an apparatus which has a carriage for mounting a head used for performing printing and for being moved along a medium, the method comprising the steps of:

controlling driving of the carriage in open loop;

detecting motion information of the carriage and obtaining a periodic signal relating to the detection; and performing control for making the head to be driven within each period of the periodic signal, in which driving timing of the head is set at ejection timing having a time interval derived by dividing a period of immediately preceding period of the periodic signal into n (:natural number).

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiment of an ink-jet printing apparatus as an example of a serial printing apparatus according to the present invention will be discussed hereinafter with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

Figure 1:
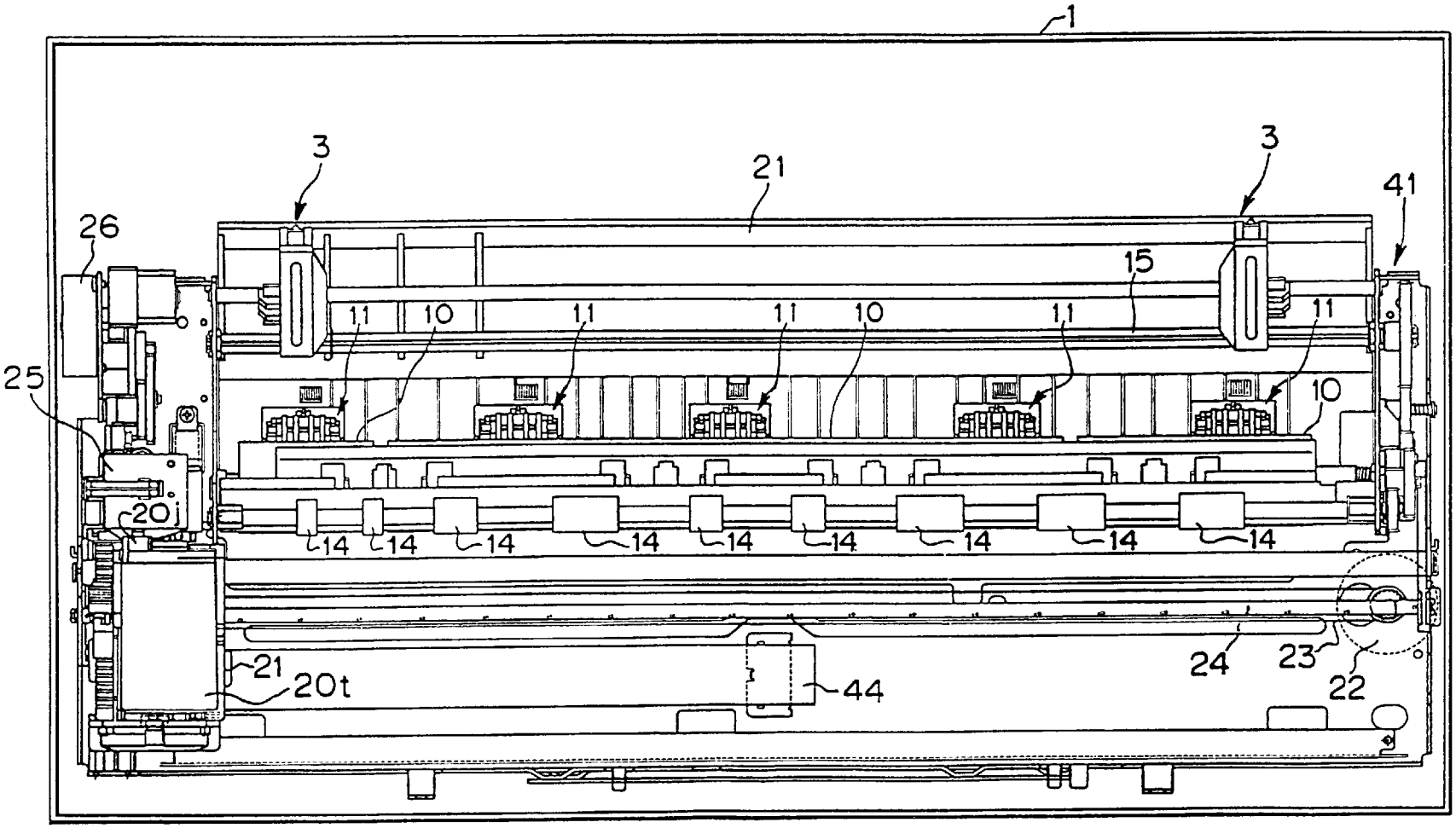
FIG. 1 is a top plan view of one embodiment of an ink-jet recording apparatus according to the present invention.
Figure 2:
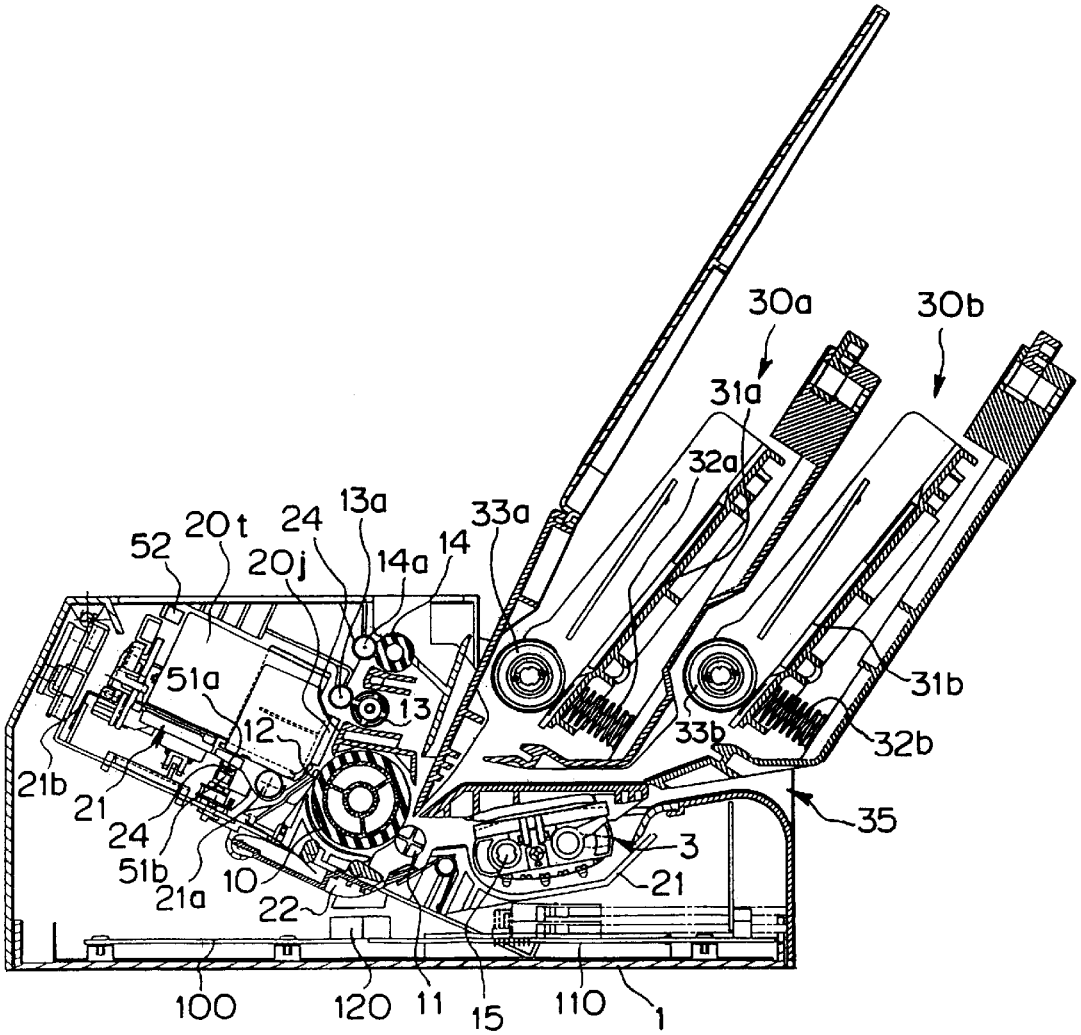
FIG. 2 is a sectional view as seen from the side of the apparatus of FIG. 1.

FIGS. 1 and 2 show a preferred embodiment of an ink-jet recording apparatus according to the present invention. FIG. 1 is a top plan view of the embodiment of an ink-jet recording apparatus, and FIG. 2 is a section in a condition where an automatic sheet feeder (hereinafter referred to as "ASF") is installed, as seen from the side of the apparatus.

The shown embodiment of the ink-jet recording apparatus may use a cutform, such as a recording paper, post card and so forth (hereinafter also referred to as "cut sheet") and a continuous paper, such as a fanhold paper and so forth.

More specifically, when a cut sheet is used, feeding of paper is normally performed by automatic feeding by means of ASF or by manual feeding. As clear from FIG. 2, the ASF has two bins 30*a* and 30*b*. By providing these bins 30*a* and 30*b*, it is enabled to simultaneously set mutually different sizes of cut sheets and to use two sizes of cut sheets selectively by selecting operation of the user, for example. Sheet feeding mechanisms in respective bins 30*a* and 30*b* have mutually identical constructions. More specifically, a plurality of cut sheets (which are neglected from illustration in FIG. 2) stacked on pushing plates 31*a* and 31*b* are urged toward pick-up rollers 33*a* and 33*b* by depression force of springs 32*a* and 32*b*. The cut sheets are separated and fed one-by-one by the pick-up rollers 33*a* and 33*b* rotating in response to a sheet feeding initiation command.

When the cut sheet is used, a register roller 11 is set to be urged toward a feed roller 10 in response to operation of a release lever (not shown). By this, the cut sheet fed from the ASF is fed by the feed roller 10 to a recording region side through a feeding path defined around the feed roller 10. At the recording region side, a paper holding plate 12 is urged toward the feed roller 10 by resilient force of a leaf spring to further apply a feeding force to the cut sheet to feed between an ink-jet head 20*j* and a platen 24. Feeding of the cut sheet at this position is performed intermittently per every one scan of the ink-jet head 20*j* (will be discussed later), and the feeding amount is generally corresponds to a arrangement length of a plurality of ink ejection orifices provided in the ink-jet head 20*j* in the feeding direction of the cut sheet.

The cut sheet, on which ink-jet recording is performed by feeding per every one scan and ink ejection from the ink-jet head 20*j*, is sequentially fed upward of the apparatus by rotation of an assist roller 13 and a take-off roller 14 (and spurs 13*a* and 14*a* depressed by the assist roller 13 and take-off roller 14).

When the continuous paper is used, the ASF is not used and the continuous paper fed through a feed opening 35 is fed by driving of a pin drafter 3. At this time, the register roller 11 is released from biasing toward the feed roller 10 by the above-mentioned release lever. The continuous paper fed to the recording region side is intermittently fed per every one scan of the ink-jet head 20*j* to be fed upward of the apparatus similarly to the foregoing case of cut sheet. During feeding through the recording region, ink-jet recording is performed.

The ink-jet head 20*j* has 136 ink ejection orifices arranged in alignment. When the ink-jet head 20*j* is installed on a carriage 21, the ejection orifice array of the ink-jet head 20 is oriented substantially along the feeding direction of the recording medium (hereinafter, this direction where the ejection orifice array is oriented is referred to as "auxiliary scanning direction").

In the shown embodiment, the ink-jet recording apparatus is adapted to perform full color printing using yellow (Y), magenta (M), cyan (C) and black (Bk) inks, and monochrome printing using Bk ink.

In the construction for performing full color printing, the ink-jet head 20*j* and an ink tanks 20*t* storing respective of Y, M, C and Bk inks, are independently installed on the carriage 21 in detachable manner. For example, when Y ink is spent out, or the ink tank 20*t* of Y ink becomes necessary to be exchanged, only the ink tank 20*t* of the Y ink may be exchanged with new one. Also, when it becomes necessary to exchange the ink-jet head 20*j*, only the ink-jet head may be exchanged.

In the construction set forth above, the 136 ink ejection orifices of the ink-jet head 20*j* are corresponding to respective inks per every given number. Corresponding to this, ink chambers and ink supply passages are defined independently of the others.

On the other hand, in the construction for performing of monochrome printing, the ink-jet head 20*j* and the ink tank 20*t* of the Bk ink are formed integrally. These are detachably installed on the carriage 21 as a unit.

As set forth above, the carriage 21, having installed the ink-jet head 20*j* and the ink tank 20*t*, is driven to move by a driving force of a carriage motor 22 transmitted via a belt 23 connected to a part of the carriage 21, as shown in FIG. 1. The carriage 21 is permitted to move as set forth above along a guide shaft 21*a* and a guide piece 21*b* extending in a lateral direction by engaging with the guide shaft 21*a* and the guide piece 21*b*. By this, it becomes possible to perform scanning for recording. The carriage 21 is moved to a home position located at a left side position of FIG. 1 during non-recording (resting) state. Then, as shown in FIG. 1, the surface of the ink-jet head 20*j* where the ejection orifices are arranged, is capped by a capping unit 25.

Motion information of the carriage 21 is detected by optical or magnetic encoder elements 51*a* and 51*b* mounted on the carriage 21 at both sides of an encoder film 24 provided in parallel to the guide shaft 21*a* and so forth (see FIG. 2). Also, exchange of electrical signals between the apparatus main body and the ink-jet head 20*j* is performed through a flexible circuit board 44.

A reflection type sensor 52 (see FIG. 2) is provided at a part of the apparatus body and adapted to read bar code information attached to the ink tank 20*t* or the ink-jet head 20*j*. By this, it becomes possible to identify individual ink tank 20*t* or ink-jet head 20*j*.

An ASF motor 26 (see FIG. 1) provided at the home position side of the apparatus main body is adapted to drive the above-mentioned pick-up roller as well as an absorption pump in the capping unit 25. On the other hand, the driving force necessary for driving the feed roller 10 and feeding of the recording medium, can be attained from an LF (line feed) motor provided at the opposite side to the home position (not shown) through a gear train 41 (see FIG. 1).

On the chassis 1 forming the bottom plate of the apparatus body, a control circuit board 100, an internal interface board 110, and a connector 120 for mutual connection with the control circuit board and the interface board, are provided.

Figure 3:
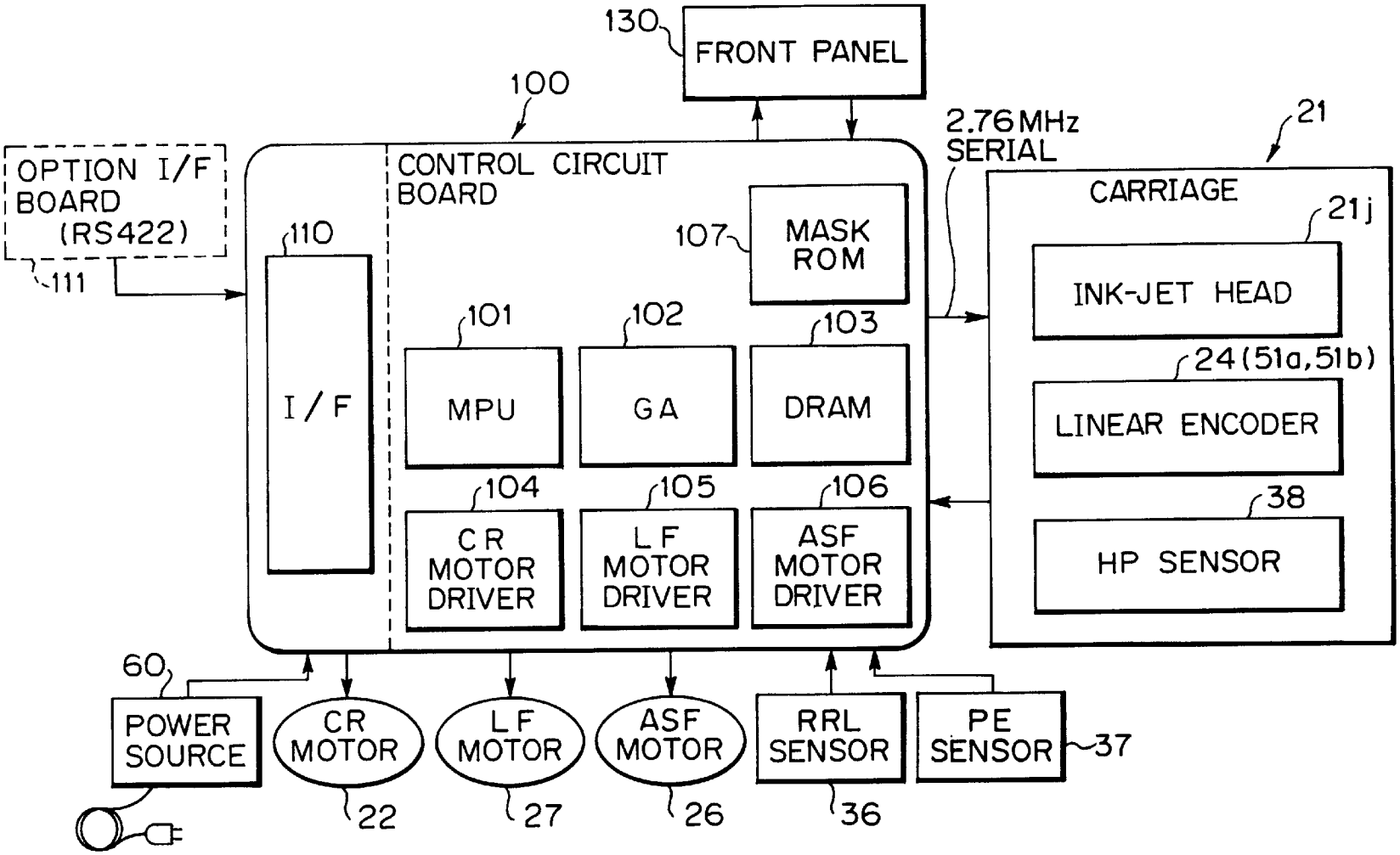
FIG. 3 is a block diagram showing a construction of a control system in the apparatus shown in FIGS. 1 and 2.

FIG. 3 is a block diagram mainly showing a construction of a control system of the ink-jet recording apparatus shown in FIGS. 1 and 2.

The control circuit board 100 is in a form of a printed circuit board. As shown in FIG. 2, the control circuit board 100 is disposed at the bottom portion of the apparatus main body. On the control circuit board 100, MPU 101, a gate array (GA) 102, a dynamic RAM (DRAM) 103 and a maskable ROM (MASKROM) 107 are provided. Also, a drive circuit for respective motors, namely carriage motor driver (CR motor driver) 104, a sheet feeder motor driver (LF motor driver) 105, and an ASF motor driver 106 are provided. Also, to the control circuit board 100, a similarly printed circuit board forming a Centronics interface (I/F) board 110 is connected. By this, it becomes possible to receive recording data and so forth from a host system.

It should be noted that in the shown embodiment of the ink jet recording apparatus, it is possible to connect different specifications of I/F board 111. By this, it becomes applicable for variety of host systems. Also, it is possible to provide other data processing functions.

In the control circuit board 100, the MPU 101 performs data processing for overall apparatus; and the MASKROM 107 stores this processing procedure. Also, DRAM 103 is used as a work area for the above-mentioned data processing. In the gate array 102, various circuits relating to the processes of the MPU 101 are formed. MPU 101 converts image data transferred from the host system via the I/F 110 into ejection data to be used in the ink-jet head 20*j* and performs operation for transferring the ejection data to the drivers of the ink-jet head 20*j* responding to the ejection timing. Also, the MPU 101 drives respective motors 22, 27 and 26 via respectively corresponding drivers 104, 105 and 106. Particularly, drive control of the CR motor 22 is performed together with the ejection timing control on the basis of the linear encoder information obtained through the carriage 21 as discussed later.

In addition, the MPU 101 performs process relating to key input and information display on a front panel and processes based on the detection information from a home position (HP) sensor 38, a release lever (RRL) sensor 36, and a paper end (PE) sensor 37.

Figure 4:
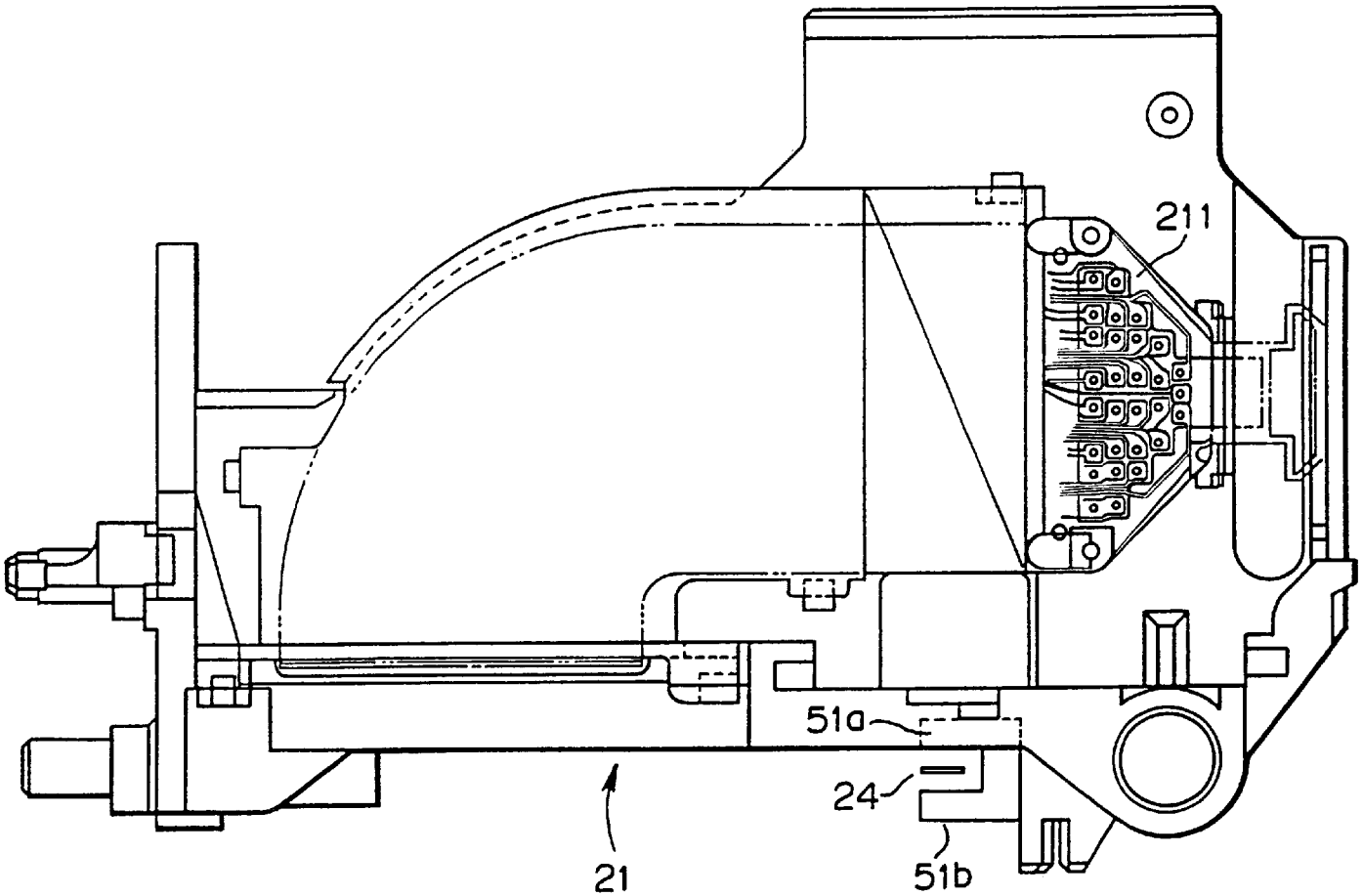
FIG. 4 is a side elevational view of a carriage in the foregoing embodiment of FIGS. 1 and 2.

FIG. 4 is a side elevation showing a detail of the carriage as illustrated in FIGS. 1 and 2.

As shown in FIG. 4, at the lower portion of the carriage, one set of encoder elements 51*a* and 51*b* is provided. This one set of encoder elements 51*a* and 51*b* is arranged across the linear encoder film 24. By this, as discussed later, the encoder output can be generated. As the encoder elements 51*a* and 51*b*, for example, a pair of light emitting element and a photosensitive element can be useed. The encoder output detected by the encoder elements 51*a* and 51*b* is fed to the control circuit board 100 shown in FIG. 3 via an apparatus main body side connection board 211 provided on the carriage 21 and the flexible board 44 (see FIG. 1). It should be noted that the connecting board 211 and a connecting board provided on the ink-jet head 20*j* are connected according to installation of the ink-jet head 20*j*.

With respect to FIGS. 1 to 4, explanation will be given hereinafter with respect to several embodiment relating to a drive control of CR motor 22 and ink ejection timing control in the above-mentioned ink-jet recording apparatus.

(EMBODIMENT 1)

Figures 5A, 5B, 5C:
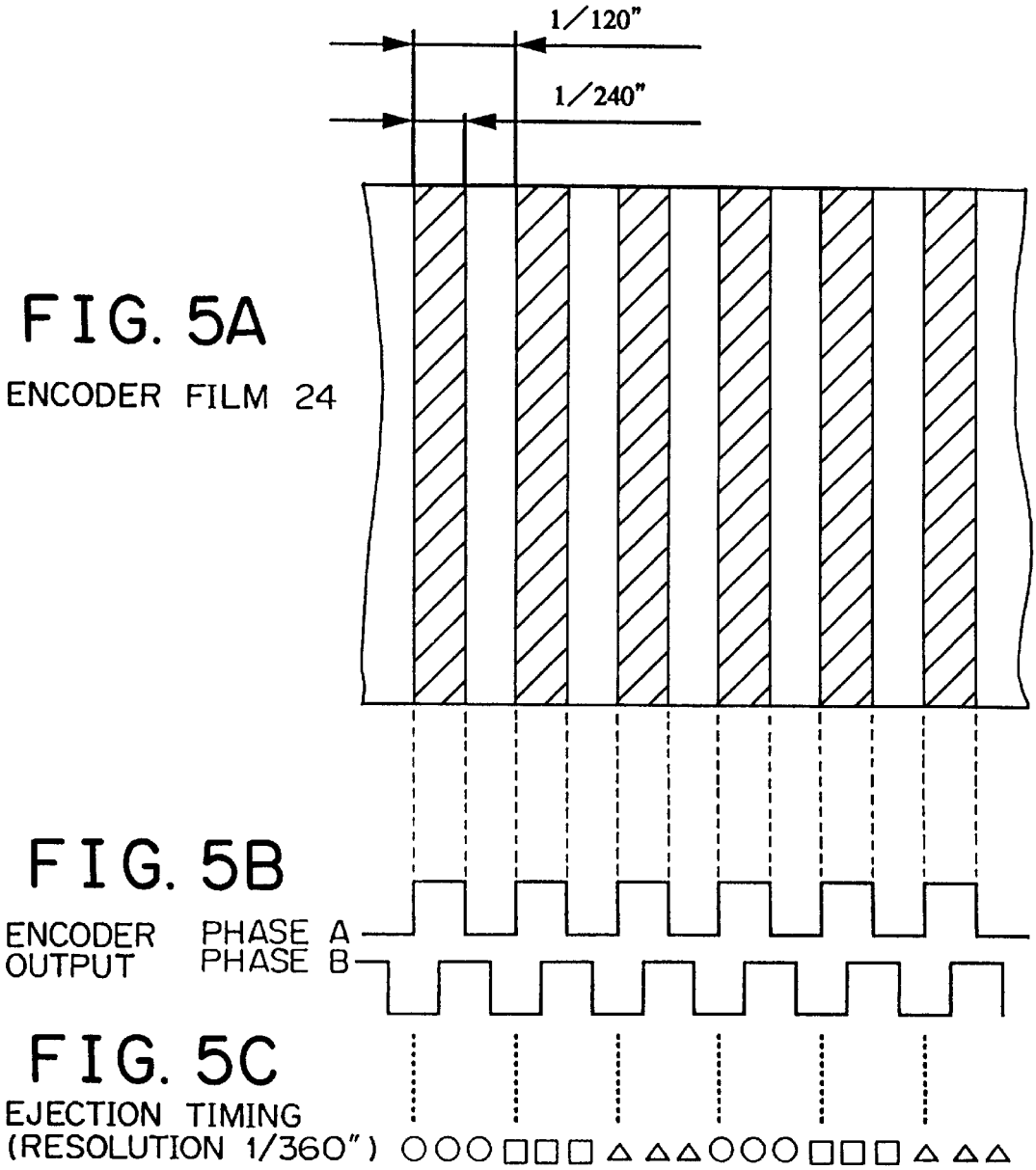
FIGS. 5A–5C depict an explanatory illustration for explaining carriage motor control and ejection timing control using an encoder output in one embodiment of the invention.

FIGS. 5A–5C comprise an illustration for brief explanation of the control of CR motor and the ejection timing control in a first embodiment.

As shown in FIGS. 5A and 5B, the encoder film 24 is provided with light non-permeable portion in half width (1/240 (inches)) and light permeable portion in the remaining half width at every 1/120 (inches) corresponding to one unit of encoder output. By this, the encoder output becomes a pair of ON and OFF pulse within the one unit. It should be appreciated that the pulse width is naturally variable depending upon variation of the speed of the carriage 21.

The CR motor 22 in the shown embodiment is a two phase stepping motor and energization of which is performed by open loop control. Accordingly, energization at respective phase is performed by a constant energization pulse at a constant interval irrespective of variation of the speed of the carriage 21.

As set forth above, driving of the CR motor 22 is performed by open loop control and ejection timing control is performed on the basis of the encoder output indicative of the speed information of the carriage. More specifically, in the shown embodiment, ejection is performed during the output pulse period corresponding to 1/120 (inches) width of the encoder film 24, and the ejection timing is determined at a time interval derived by dividing the period into three. Furthermore, the period divided into three is taken as the immediately preceding encoder pulse period.

Figure 6A:
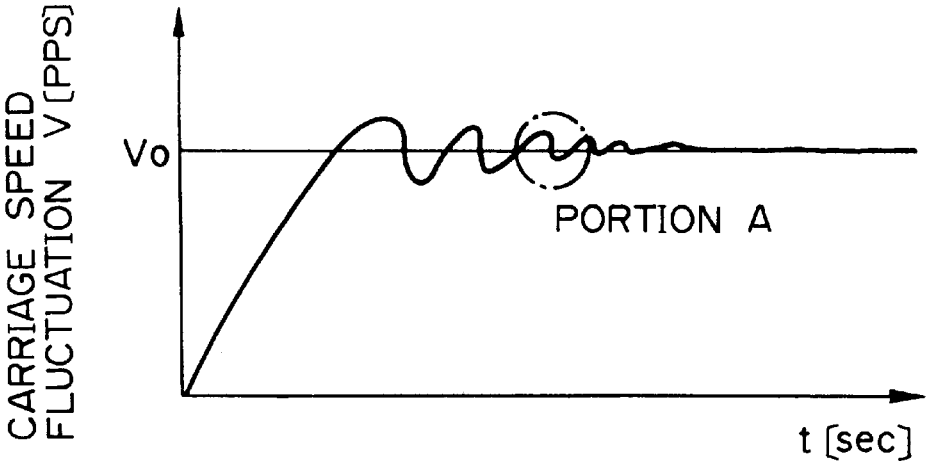
FIGS. 6A to 6B are explanatory illustrations showing detail of the foregoing ejection timing control.
Figure 6B:
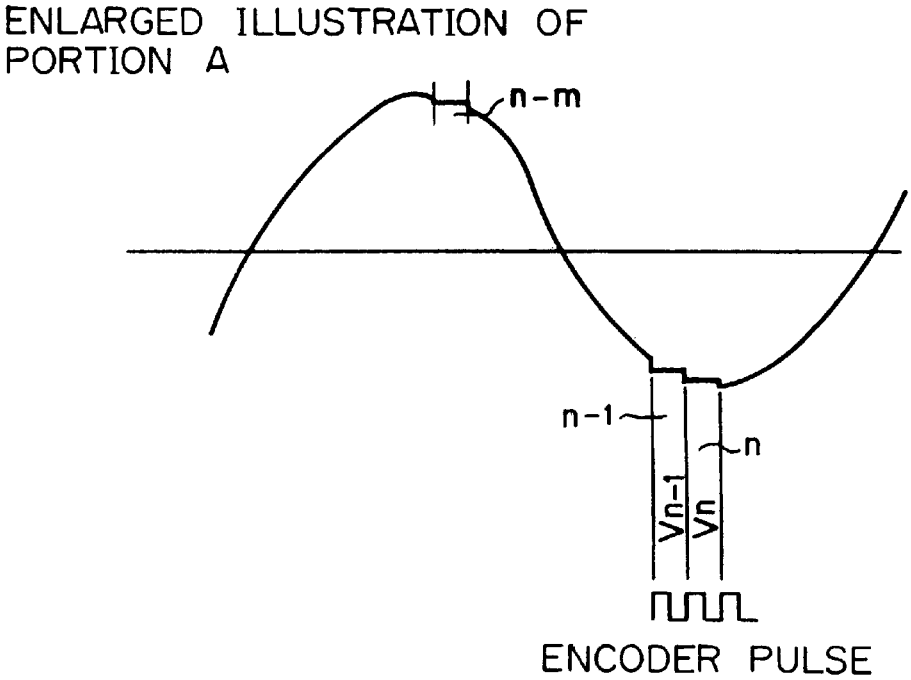

FIGS. 6A and 6B are diagrams showing explanation for division of the period into three set forth above.

As shown in FIG. 6A, the speed of the carriage past the acceleration region fluctuates vibratingly with respect to a predetermined speed $V_O$ as center value and gradually converge into the center value $V_O$. Even during such fluctuation, ejection of ink is performed. Therefore, as illustrated in FIG. 6B which shows the portion A in FIG. 6A in enlarged magnification, ink ejection corresponding to the nth encoder pulse is performed at a timing determined by dividing the (n−1)th encoder pulse into three.

Figure 7:
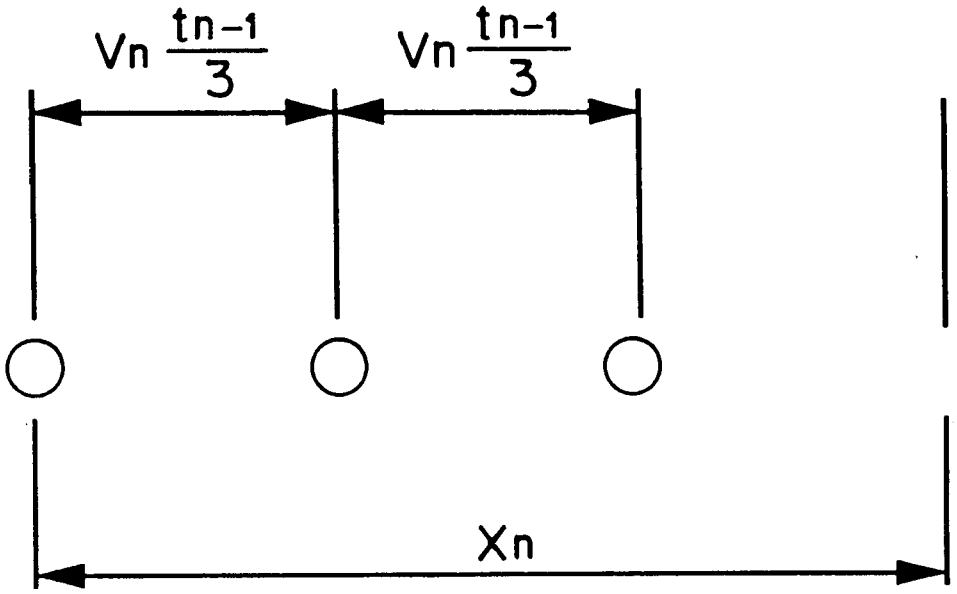
FIG. 7 is a diagrammatic illustration showing the result of ejection timing control by ink-dot arrangement.

FIG. 7 is an explanatory illustration showing the manner of division. During the period $t_n$ of the nth encoder pulse, the carriage is moved in a distance of $x_n$. During this period, the timing of ink ejection is determined so that the pitch of initially formed two dots becomes $v_n \times t_{n-1}/3$. More specifically, the ejection timing of the shown embodiment is adapted to perform ejection at a timing derived by dividing the pulse period into three within each period of the encoder pulse. Then, by taking the period $t_{n-1}$ of the immediately preceding encoder pulse, at which the differences of the period and speed are minimum, as the period to be divided into three, relatively high precision can be obtained. In contrast to this, if the period $t_{n-m}$ of the (n−m)th encoder pulse which is far in time from the current encoder pulse to perform ink ejection (see FIG. 6B), the dot pitch becomes $v_n \times t_{n-m}/3$ which can be far different from $v_n \times t_n/3$. Also, even when the period is relative to a predetermined speed $v_O$, it is still possible to have large difference with $v_n \times t_n/3$. With the shown embodiment, even by performing control of the carriage motion in open loop, by using the immediately preceding pulse period in ejection timing control, influence of the fluctuation of the carriage speed can be minimized to permit to precise determination of the dot position to be formed.

On the other hand, since the density of the ejection timing is increased to be three times higher by simply performing calculation of division into three with respect to each period of the encoder output pulse. Therefore, it becomes possible to perform high resolution recording without useing the encoder having high resolution.

It should be noted that, if the carriage speed is constant, increasing of the density of ejection timing results in driving of the ink-jet head at higher frequency. Therefore, the shown embodiment is applicable for the ink-jet head to be driven at higher frequency than the normal frequency, such as ink-jet head capable to be driven at higher than or equal to 10 KHz, for example. Also, the shown embodiment is applicable for high density printing, such as greater than or equal to 600 dpi.

Also, while the encoder pulse period is divided into three in the shown embodiment, the application of the present invention is not limited to this, and the number of divisions may be determined depending upon the specification of the apparatus and resolution of the ink-jet head and so forth. In general, when the resolution of the encoder is n in value to the ejection orifice density of the ink-jet head, the above-mentioned pulse period may be divided into n in number.

Also, while the foregoing embodiment is disclosed for fluctuation upon rising of the carriage speed as the speed fluctuation, it should be naturally understood that the application of the present invention is not limited to this. For instance, the present invention is applicable for the variation of the speed in some factor after concerning of the carriage speed at the constant speed.

(MODIFICATIONS)

Explanation will be given hereinafter for modifications based on the foregoing embodiment.

1) A recording mode in the ink-jet recording apparatus is set as two modes, i.e., high quality image mode and low noise mode. In this case, in the high quality image mode, similarly to the foregoing embodiment, open loop control may be performed for the CR motor and ejection timing control for recording may be performed by dividing the encoder pulse.

On the other hand, in low noise mode, the carriage speed may be set to be lower and control of the CR motor may be performed in closed loop. In such low noise mode, since the recording speed is lowered by lowering the carriage speed, the influence of the closed loop control in lowering of the through-put will not become noticeable. Also, by lowering of the speed, in addition to lowering of noise, vibration of the stepping motor serving as the CR motor can be reduced by closed loop control to contribute to further lower the noise.

2) In the foregoing embodiment, in the control for moving the carriage to the capping position, closed loop control may be performed at least at an area in the vicinity of the capping position. This is because that, in positioning of the cap and the ink-jet head, precise carriage position control is much more important than motion speed.

3) In the foregoing embodiment, closed loop CR motor control may be effected in the acceleration region and deceleration region. By this, in addition to lowering of noise similarly to the above, the inertia information of the carriage may be fed back to allow efficient acceleration and deceleration to improve through-put in these regions. Also, by efficient acceleration and deceleration, electric power consumption can be minimized to restrict rising of temperature of the apparatus.

4) When a non-recording data portion, namely the portion where the record becomes blank, is present in the recording data in a width greater than or equal to a predetermined width, the carriage motion control in this portion may be performed in closed loop control. By this, electric power application becomes optimized to avoid unnecessary rising of the temperature of the apparatus. Furthermore, it becomes possible to optimize skip control to realize speeding-up and lowering of noise.

Preferred embodiments of an ink-jet printing apparatus as an example of a serial printing apparatus have been described and the present invention will now be advantageously applicable to a thermal-transfer printing apparatus, a thermal-sensitive printing apparatus or the like.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be useed that solidify at a temperature lower than the room temperature and are softened or liquefied in the room temperature. This is because in the ink jet system, the ink is generally temperature adjusted in a range of 30° C. –70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be used not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An apparatus for using a head and performing printing on a medium, comprising:

a carriage for mounting the head and for moving along the medium;

carriage driving means for driving the carriage to move;

head driving means for driving the head to perform printing;

detecting means for detecting motion information of said carriage to supply a periodic signal relating to the detection; and control means for controlling driving by said carriage driving means in open loop and for performing driving timing control of said head driving means so that the head is driven within each period of the periodic signal supplied from said detection means, wherein said control means equally divides an immediately preceding period of the periodic signal into n: a natural number, so as to perform driving timing control of said head driving means so that the head is driven at each of times which have intervals equal to each other.

2. An apparatus as claimed in claim 1, wherein said detecting means comprises an encoder, said encoder supplying the periodic signal and a resolution of said encoder relating to the periodic signal is 1/n of a resolution of a printing element array of the head.

3. An apparatus as claimed in claim 2, wherein said carriage driving means comprises a stepping motor, said stepping motor generating a driving force used for moving said carriage.

4. An apparatus as claimed in claim 3, wherein said control means performs closed loop control for controlling said carriage driving means in an operational mode for low motion speed of said carriage.

5. An apparatus as claimed in claim 4, wherein said control means performs closed loop control for controlling said carriage driving means in an acceleration region and a deceleration region in motion of said carriage.

6. An apparatus as claimed in claim 5, wherein said control means performs closed loop control for controlling said carriage driving means in connection with carriage motion, in which a non-driving state of the head longer than or equal to a predetermined length is present.

7. An apparatus as claimed in claim 1, wherein the head ejects ink so as to perform printing on the medium.

8. An apparatus as claimed in claim 7, wherein the head ejects a plurality of inks so as to perform color printing.

9. An apparatus as claimed in claim 8, wherein said control means performs closed loop control for controlling said driving means when said carriage is moved to a capping position of the head.

10. An apparatus as claimed in claim 9, wherein the head generates a bubble in the ink by utilizing thermal energy and ejects the ink by generation of the bubble.

11. An apparatus as claimed in claim 1, further comprising transport means for transporting the medium on which printing is performed.

12. An apparatus as claimed in claim 1, further comprising reading means for reading an original for copying.

13. An apparatus as claimed in claim 1, further comprising transmitting means for transmitting data and receiving means for receiving data to perform facsimile functions of transmitting and receiving data.

14. An apparatus as claimed in claim 1, further comprising means for connection as an image output terminal of a computer.

15. A drive control method for an apparatus which has a carriage for mounting a head used to be driven for performing printing and for being moved along a medium, said method comprising the steps of:

controlling driving of the carriage in open loop;

detecting motion information of said carriage and obtaining a periodic signal relating to said detection; and performing control for controlling the head to be driven within each period of the periodic signal, in which the head is driven at each of times which have intervals equal to each other, the equal intervals being derived by equally dividing an immediately preceding period of the periodic signal into n: a natural number.

16. A drive control method as claimed in claim 15, wherein the head ejects ink so as to perform printing on the medium.

17. A drive control method as claimed in claim 16, wherein the head generates a bubble in the ink by utilizing thermal energy and ejects the ink by generation of the bubble.

* * * * *

UNITED STATES PATENT AND TRADEMARK OFFICE

CERTIFICATE OF CORRECTION

PATENT NO. : 5,936,645

DATED : August 10, 1999

INVENTOR(S) : TAKEJI NIIKURA, ET AL.

It is certified that error appears in the above-identified patent and that said Letters Patent is hereby corrected as shown below:

Title page

[57] Abstract:

Line 1, "useing" should read --using--.

COLUMN 1:

Line 13, "i.e." should read --i.e.,--; and

Line 29, "recording)." should read --as recording).--.

COLUMN 3:

Line 32, "fanhold" should read --fanfold--; and

Line 60, "is" should be deleted; and "to a" should read --to an--.

COLUMN 4:

Line 25, "tanks" should read --tank--.

COLUMN 5:

Line 32, "variety" should read --a variety--; and

Line 63, "pair of" should read --pair consisting of a--.

COLUMN 6:

Line 6, "embodiment" should read --embodiments--;

Line 22, "motor and" should read --motor,--;

Line 24, "phase" should read --phases--;

Line 42, "converge" should read --converges--;and

Line 64, "period is" should read --period $t_0$ is--.

UNITED STATES PATENT AND TRADEMARK OFFICE

CERTIFICATE OF CORRECTION

PATENT NO. : 5,936,645

DATED : August 10, 1999

INVENTOR(S) : TAKEJI NIIKURA, ET AL.

COLUMN 7:

Line 8, "pulse. Therefore," should read --pulse,--; and

Line 9, "useing" should read --using--.

COLUMN 9:

Line 34, "useed" should read --used--.

COLUMN 10,

Line 54, "driving" should read --carriage driving--.

Signed and Sealed this

Thirtieth Day of May, 2000

*Attest:*

*Attesting Officer*

Q. TODD DICKINSON

*Director of Patents and Trademarks*